US008953985B2

(12) United States Patent
Namiki

(10) Patent No.: US 8,953,985 B2
(45) Date of Patent: Feb. 10, 2015

(54) CHARGING MEMBER AND IMAGE FORMING APPARATUS

(75) Inventor: Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 13/313,221

(22) Filed: Dec. 7, 2011

(65) Prior Publication Data

US 2012/0148307 A1 Jun. 14, 2012

(30) Foreign Application Priority Data

Dec. 14, 2010 (JP) ..... 2010-278184

(51) Int. Cl.
*G03G 15/02* (2006.01)

(52) U.S. Cl.
CPC ..... *G03G 15/0233* (2013.01); *G03G 2215/021* (2013.01)
USPC ..... 399/174; 399/115

(58) Field of Classification Search
CPC ..... G03G 15/0233
USPC ..... 399/174
See application file for complete search history.

(56) References Cited

U.S. PATENT DOCUMENTS 5,126,913 A * 6/1992 Araya et al. ..... 361/225
5,353,101 A * 10/1994 Adachi et al. ..... 399/174
5,576,805 A * 11/1996 Ishihara et al. ..... 399/176
5,842,081 A * 11/1998 Kaname et al. ..... 399/50
6,360,065 B1 3/2002 Ishibashi et al.
2012/0148308 A1* 6/2012 Imamura ..... 399/174
2012/0148309 A1* 6/2012 Oshima et al. ..... 399/174
2013/0170859 A1* 7/2013 Kishi et al. ..... 399/174

FOREIGN PATENT DOCUMENTS

CN 1282891 A 2/2001
JP 8-62937 A 3/1996
JP 8-62938 A 3/1996
JP 9-319183 A 12/1997

OTHER PUBLICATIONS

Office Action in Chinese Patent Application No. 201110416432.7, dated Jan. 30, 2014 (with English translation).

* cited by examiner

*Primary Examiner* — Benjamin Schmitt
(74) *Attorney, Agent, or Firm* — Fitzpatrick, Cella, Harper & Scinto

(57) ABSTRACT

A blade-like charging member for charging a surface of an image bearing member by contacting the image bearing member and by being supplied with a voltage. The blade-like charging member includes a charging portion for effecting electric discharge to the surface of the image bearing member, and a non-charging portion not effecting the electric discharge to the surface of the image bearing member. The non-charging portion is capable of contacting the image bearing member while maintaining an electrically dischargeable gap between the charging portion and the image bearing member. At least a part of the non-charging portion is made of a material having a higher resistance than that of the charging portion so as to prevent electric discharge between the non-charging portion and the surface of the image bearing member.

8 Claims, 14 Drawing Sheets

(a)

(b)

(a)

(b)

(c)

CHARGING MEMBER AND IMAGE FORMING APPARATUS

FIELD OF THE INVENTION AND RELATED ART

The present invention relates to a blade-like charging member for charging a surface of an image bearing member, the charging member being moved relative to an image bearing member (member to be charged) carrying an electrostatic latent image in contact thereto while being supplied with a voltage, and to an image forming apparatus using the charging member.

Here, a typical example of the image bearing member on which the electrostatic latent image is formed is an electrophotographic photosensitive member or a dielectric member for electrostatic recording. As for the image forming apparatus, there are an electrophotographic type or electrostatic recording type copying machine, printer, facsimile machine or a complex machine thereof, and an image display device or the like.

The description will be made as to a transfer type electrophotographic image forming apparatus, taking for example. Generally, in such an apparatus, the electrostatic latent image of image information is formed by charging means for charging uniformly a surface of the image bearing member (rotatable drum type electrophotographic photosensitive member) to a predetermined polarity and potential and by exposure means for selectively exposing the thus charged drum surface to the light of the image information. The latent image is visualized (developed) into a toner image using a developer (toner) by developing means. The toner image is transferred onto a recording material (recording material) by transferring means. The transferred toner image is fixed by fixing means into a fixed image on the recording material, and then the recording material is outputted as a print.

A recently dominant charging means (charging device) is a contact-charging type means using a fixed type charging member such as a blade or film, or a rotating type charging member such as a brush, roller, belt of semiconductive rubber or resin material.

The contact-charging type does not necessitate an ozone removing filter because the amount of produced ozone is small. The required voltage applied to provide the surface of the drum with a predetermined potential may be small, and therefore, the cost can be reduced.

A charging mechanism of the contact-charging type will be described. It is known that the charging mechanism for the drum surface in the contact charging system is ruled by the Paschen law relating to the electric discharge in a small gap.

1) In the Case of Charging Roller:

Referring to FIG. 15, parts (a) and (b) are a schematic perspective view and a schematic sectional view of a charging roller using a rotating type charging roller 21 as the charging member. The charging roller 21 comprises an electroconductive core metal and the electroconductive elastic layer 21*b* formed on the core metal 21*a* concentrically therewith. The drum 1 comprises an electroconductive drum base member 12 and a photosensitive layer formed on the outer surface of the drum base member 12. The charging roller 21 is substantially parallel with the drum 1 and is contacted at a predetermined urging force.

The charging roller 21 has a length to cover an image forming region (maximum image region width) G of the surface of the drum 1 and is rotated by the rotation of the drum 1. To the core metal 21*a* of the charging roller 21, a predetermined charging bias voltage is applied from the charging bias voltage applying source E so that a bias voltage is applied to the elastic layer 21*b* through the core metal 21*a*. By this, the surface of the rotation drum 1 is charged uniformly to the predetermined polarity and potential.

Part (c) of FIG. 15 shows an electrical equivalent circuit of the drum 1 and the air layer of the fine gap concerned with the discharge between the charging roller 21 and the drum 1. An impedance of the charging roller 21 is small as compared with that of drum 1 and that of the air layer, and therefore, it is neglected here. Then, charging mechanism can be expressed by two capacitors C1, C2 simply. When a DC voltage is applied to the equivalent circuit, the is divided proportionally to the impedances of the capacitors, and therefore, the voltage Vair across the air layer is, $$V\text{air}=C2/(C1+C2) \quad (1)$$

The air layer has a dielectric breakdown voltage determined by the Paschen law, and it is as follows when the thickness of the air layer is g [micron]:

$$312+6.2\ g\ [V] \quad (2)$$

When Vair exceeds this, the discharge occurs.

The minimum discharging voltage is that when formula (1) is equal to formula (2) and the air layer thickness g obtained by the equation has a double root (C1 is also a function of g), and a DC voltage value at this time is a discharge starting voltage Vth. The theoretical value Vth thus obtained is very close to an experiment value.

The charging roller tends to be complicated in the structure since it requires a rotatable supporting member 211, an urging spring 212 and so on for the charging roller 21. A brush charging member (charging brush) is time-consuming in manufacturing the brush irrespective of whether it is rotating type or fixing type, and tracks of the brush fibers may result in unevenness of charging.

2) In the Case of Charging Blade:

Part (a) of FIG. 16 is a schematic perspective view of a charging blade using a fixing type charging blade 22 as the charging member. The charging blade comprises an electroconductive elastic blade portion 220 as a charging blade 22 and an electroconductive supporting member 223 supporting the blade portion 220. The blade portion 220 has a length enough to cover the entire width of the image forming region of the surface of the drum 1. The charging blade 22 is set substantially parallel with the drum 1, the blade portion 220 is contacted to the, and the supporting member 223 is fixed to a stationary member).

A predetermined charging bias voltage is applied from a charging bias voltage applying source to the supporting member 223, so that the bias voltage is applied to the blade portion 220 through is supporting member 223. By this, the surface of the rotation drum 1 is charged uniformly to predetermined polarity and potential. The discharge occurs in the wedged small gap formed between the blade portion 220 and the drum 1, and a relatively stable small gap can be formed. The rotation supporting member 211 and the urging spring 212 and so on required by the charging roller are unnecessary, and therefore, the blade type is inexpensive.

However, a part of the blade portion 220 of the charging blade 22 is always in contact with the drum 1, and therefore, involves the following problems.

A: as shown in part (b) of FIG. 16, the toner T or the like having passed through the contact portion between the blade portion 220 and the drum 1 may accumulate gradually in the small gap g. Increased accumulation of the toner T or the like prevents the discharge with the result of an image defect in the form of stripes.

B: in order to prevent pin hole leakage which is a leakage of the voltage applied to the blade portion 220 through pin holes existing on the surface of the drum 1, a protection layer is provided on the blade portion 220 at the position contacting the drum 1 in many cases. In such cases, the protection layer is worn with long term use, and then the pin hole leakage may occur.

Japanese Laid-open Patent Application Hei 09-319183 proposes a structure of a charging blade comprising a semiconductive portion for effecting discharge, and an insulative portion for contacting the drum o position the semiconductive portion with a small gap from the drum. With such a structure, the semiconductive portion and the drum are always kept non-contact, and therefore, the pin hole leakage is suppressed for long term use.

Japanese Laid-open Patent Application Hei 08-62937 proposes a having comprising a blade of an insulative elastic member and a charging electrode layer provided on the surface of the blade opposing the drum. By setting properly a distance from a free end of the blade to the free end of the charging electrode layer, the influence of the accumulation of the toner or the like on the charging electrode layer suppressed to form images without the image defect.

Japanese Laid-open Patent Application Hei 08-62938 proposes a structure comprising a blade of an insulative elastic member, and a charging electrode layer provided on the surface of the blade opposing the drum, wherein a convex portion is provided which separates from the drum surface and then approaches to the drum. This is advantageous in that the distance through free end of the blade to the free end of the charging electrode layer can be made longer than in Japanese Laid-open Patent Application Hei 08-62937, thus stabilizing the image formation without the stripes.

Because of the recent demand for downsizing of the image forming apparatus and for reducing the weight, the following problems arise. When the charging blade and the drum are press-contacted to each other, virtual bites of the blade at the longitudinal end and central portions of the drum are different, as shown in part (a) of FIG. 17. The difference increases with decrease of the diameter of the drum as shown in (b).

In the above-described prior art, there is a relation shown in part (c) of FIG. 17 between the virtual blade bite and the gap between the semiconductive portion and the drum. When a difference is produced in the virtual blade bite between the longitudinal end and center portions due to deformation of the drum, the gap becomes uneven along the longitudinal direction. Therefore, the surface potential of the drum becomes unstable, with the result of unstable image quality, and therefore, a further improvement is desired to stabilize the gap between the charging portion of the blade and the drum even when the drum deforms.

SUMMARY OF THE INVENTION

Accordingly, it is a object of the present invention to provide a blade-like charging member capable of effecting stabilized charging with suppressed influence of a flexure of an image bearing member, and an image forming apparatus using the charging member.

According to an aspect of the present invention, there is provided a blade-like charging member for charging a surface of an image bearing member by contacting thereto and by being supplied with a voltage, said charging member comprising a charging portion for effecting electric discharge to the surface of the image bearing member; a non-charging portion not effecting the electric discharge to the surface of the image bearing member; wherein non-charging portion capable of contacting said image bearing member with maintaining an electrically dischargeable gap between said charging portion and said image bearing member, at least a part of said non-charging portion is made of a material having a higher resistance than that of said charging portion so as to prevent electric discharge between said non-charging portion and the surface of said image bearing member, and an amount of deformation of said charging member when a force is applied to said non-charging portion in a longitudinally central portion is larger than an amount of deformation of said charging member when the same force is applied to said non-charging portion in a longitudinally end portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

[Embodiment 1]

Figure 2:
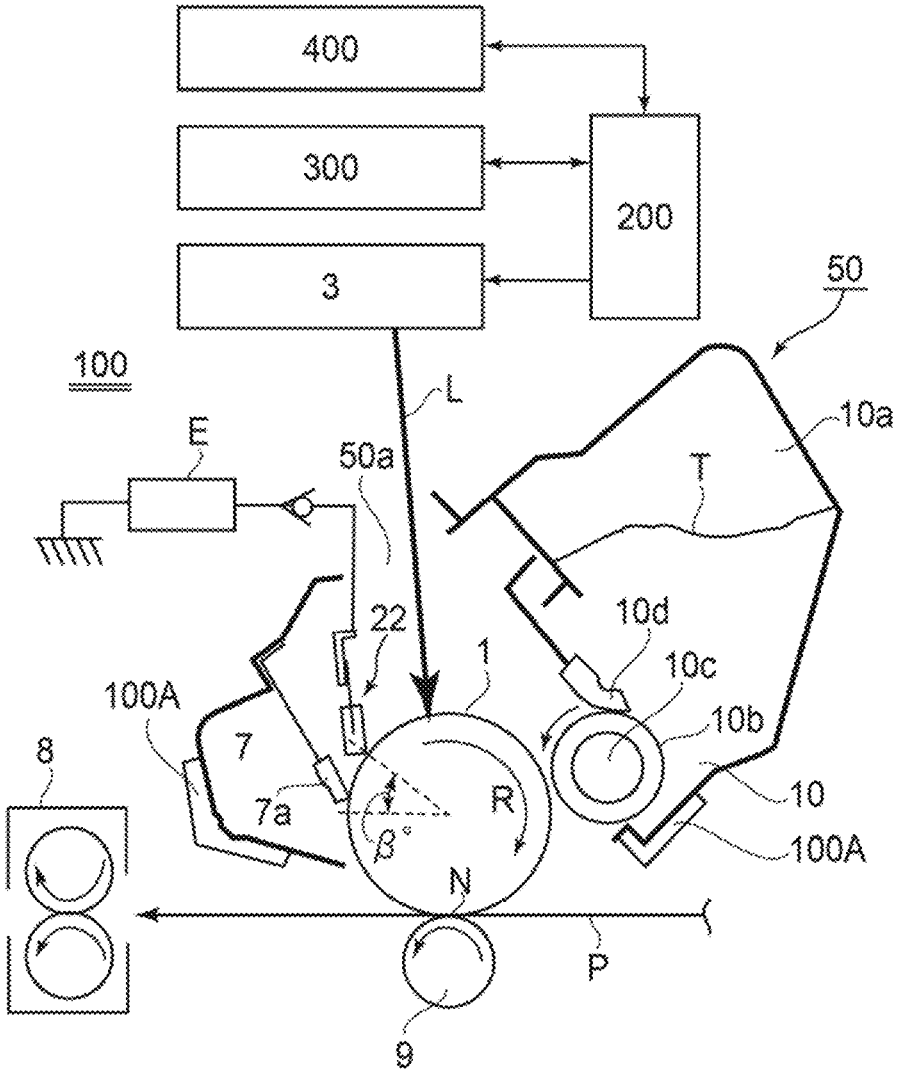
FIG. 2 is a schematic illustration of an example of an image forming apparatus.

(1) General Structure of an Example of an Image Forming Apparatus and an Image Forming Operation Thereof:

Referring first to FIG. 2, there is shown an example of an image forming apparatus 100 using a charging member 22 according to the present invention. The device 100 is an electrophotographic image forming apparatus of a process cartridge mounting and demounting type using an electrophotographic process. The device 100 forms an image on a recording material (recording material) P on the basis of an electrical image signal inputted to a control circuit portion (control means, CPU) 200 from a host apparatus 400 such as a personal computer, an image reader or a facsimile machine.

The recording material P is a sheet on which an image can be formed by an electrophotographic process, and is a sheet of paper, a resin material sheet, a label or the like. The control circuit portion 200 exchange various electrical information with an operating portion 300 or the host apparatus 400, and controls overall image forming operation of the device 100 in accordance with predetermined control program and reference table stored in a storing portion.

In a main assembly of the apparatus of the device 100, there is provided a cartridge accommodating portion 100A. A process cartridge 50 is demountably mounted to the cartridge accommodating portion 100A through a predetermined operation manner. In this embodiment, the cartridge 50 is an integral type process cartridge. More particularly, an electrophotographic photosensitive drum as an image bearing member on which an electrostatic latent image developed with a developer T is formed, charging means 22, developing means 10 and cleaning means 7 are mounted to a common casing into a unit.

In this embodiment, the charging means 22 is a charging blade. The charging blade 22 will be described hereinafter. The developing means 10 is a non-contact-type developing device operable with one component magnetic toner as the developer T. In the following, the developer T will be called toner, too. The cleaning means 7 is a blade cleaning device using an elastic blade 7*a* as a cleaning member.

The developing device 10 includes a developing container 10*a* as a developer accommodating portion accommodating the toner T. It also includes a developing sleeve 10*b* as a developer carrying member for developing an electrostatic latent image formed on the drum 1 into a toner image, a non-rotatable magnet roller 10*c* provided in the sleeve 10*b*, a developing blade 10*d* for regulating an amount of the toner on the developing sleeve 10*b*, and so on.

Above the cartridge accommodating portion 100A, there is provided a laser scanner unit 3 as image exposure means. The unit 3 outputs a laser beam L modulated in accordance with the image information inputted to the control circuit portion 200 from the host apparatus 400. The laser beam L enters the cartridge 50 through an exposure window provided in a top side. By doing so, the surface of the drum 1 is scanningly exposed to a laser beam.

To the drum 1 in the cartridge 50, a transfer roller 9 is contacted to form a transfer nip N. The cartridge 50 accommodated in the cartridge accommodating portion 100A is urged to a positioning portion (unshown) in the main assembly side of the apparatus by an urging means (unshown) is correctly positioned. In addition, a drive outputting portion (unshown) of the main assembly side of the apparatus is connected to a drive inputting portion (unshown) of the cartridge 50. To various electrical contacts (unshown) of the cartridge 50, the corresponding electrical contacts (unshown) of the main assembly side of the apparatus are contacted.

The image forming operation is as follows. Drum 1 is rotated in the clockwise direction indicated by arrow R at a predetermined peripheral speed (process speed). The unit 3 is also driven. In synchronism with the drive, a predetermined charging bias voltage is applied from a charging bias voltage applying source E to the charging blade 22 at predetermined control timing so that the surface of the drum 1 is charged uniformly to the predetermined polarity and potential by the charging blade 22 by a non-contact type charging. The unit 3 scans and exposes the surface of the drum 1 by a laser beam L modulated in accordance with the image signal. By this, an electrostatic latent image is formed in accordance with the image signal on the surface of the drum 1.

The electrostatic latent image thus formed is developed into a toner image by the toner carried on the developing sleeve 10*b* of the developing device 10. The developing sleeve 10*b* is rotated in a counterclockwise direction indicated by an arrow at a predetermined speed. To the developing sleeve 10*b*, a predetermined developing bias voltage is applied at predetermined control timing from a developing bias applying voltage source portion (unshown).

On the other hand, one recording material P is separated and fed out of a sheet feeding mechanism portion (unshown) and is introduced into the transfer nip N at predetermined control timing and is nipped and fed through the nip N. During the recording material P moving the nip N, a predetermined transfer bias is applied to the transfer roller 9 from a transfer bias application voltage source portion (unshown) By this, the toner image is transferred from the drum 1 onto the surface of the recording material P sequentially.

The recording material P having passed through the nip N is separated from the surface of the drum 1 and is introduced into the fixing device 8. In this embodiment, the fixing device 8 is a heat roller fixing device, and the recording material P is nipped and fed by a fixing nip and is subjected to heat and pressure. By this, the unfixed toner image on the recording material P is heat-pressure fixed into a fixed image. The recording material P discharged from the fixing device 8 is discharged from the device 100 as a print. The surface of the drum 1 after the recording material is separated, is cleaned by a cleaning blade 7*a* so that deposited residual matter such as untransferred toner is removed therefrom, thus it is prepared for the next image formation.

(2) Charging Blade 22

The charging blade 22 is contacted to the drum counterdirectionally with respect to the rotation of the drum 1 at a position of β degree from a horizontal line passing through the center of the drum 1 (the angle β is formed between the horizontal line and a line connecting the drum center and the contact position between the drum 1 and the blade 22)

Figure 3:
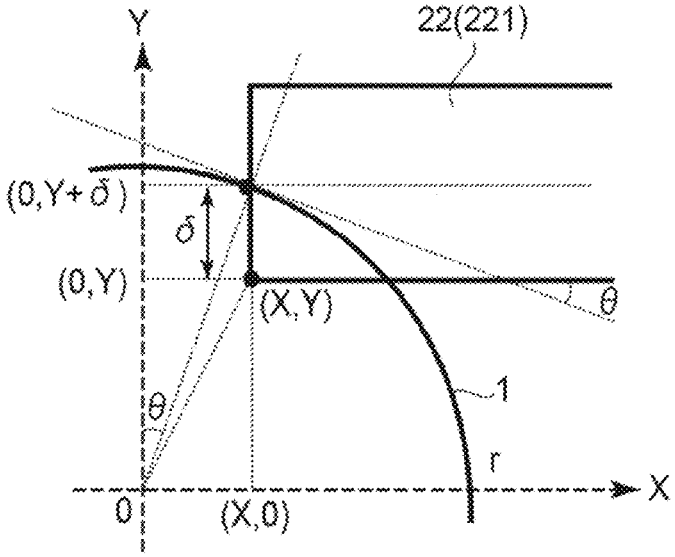
FIG. 3 illustrates a virtual bite δ of a charging blade.

As shown in FIG. 3, the blade 22 enters the drum 1 if the drum 1 is phantom, and the entering distance δ is called virtual bite; actually, the charging blade 22 deforms by this distance by the press-contact between the charging blade 22 and the drum 1 so that the behavior of the charging blade is stabilized.

Here, an example of determining an actual virtual bite δ and a setting angle θ. The charging blade 22 and the drum 1 are set in the state of image forming operation, and the drum 1 is removed, and then the virtual bite δ and the θ are measured. In FIG. 3, the shown drum 1 is a phantom drum 1 during image formation. X axis passes through the center of the phantom drum and is parallel with such a surface of the charging blade 22 as is opposed to the drum 1. Y axis is perpendicular to the X shaft and passes through the center of the phantom drum 1.

As shown in FIG. 3, coordinate (X, Y) of the free end of the charging blade 22 is determined. From the coordinate and the radius r of the phantom drum 1 the virtual bite δ and the setting angle θ can be obtained by equation (1) and equation (2).

$$\delta=\sqrt{(r^2-X^2)} \quad (1)$$

$$\theta=\tan^{-1}(X/r) \quad (2)$$

Figure 1:
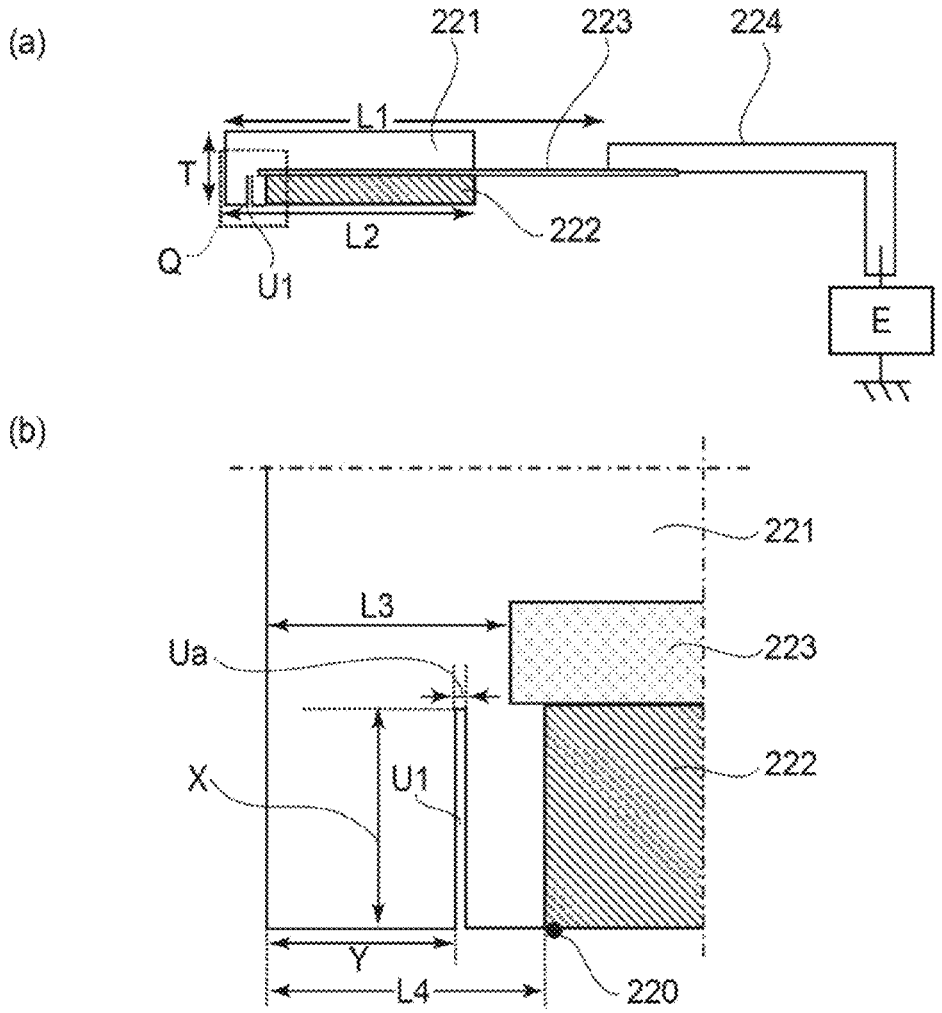
FIGS. 1(*a*) and 1(*b*) are illustrations of a charging blade according to Embodiment 1 of the present invention.

Part (a) of FIG. 1 is an enlarged schematic cross-sectional view of the charging blade 22 of the device 100 of FIG. 2, and part (b) is an enlarged view of a free end portion (broken line portion Q in (a)) of the blade 22. The charging blade 22 of this embodiment contacts the drum 1 and moves relative thereto, and a voltage is applied thereto by which the surface of the drum 1 is charged. It comprises an electroconductive charging portion 222 for effecting discharge to the surface of drum 1, and a non-charging portion 221 which does not effect the discharge to the surface of drum 1.

Figure 4:
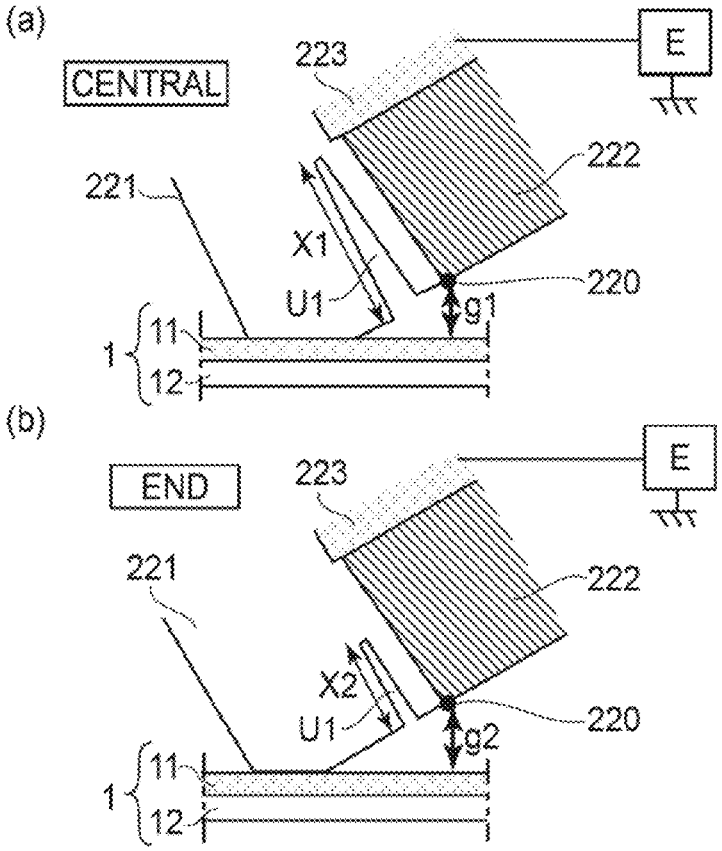
FIGS. 4(*a*) and 4(*b*) illustrate a function of the charging blade in Embodiment 1.

The non-charging portion 221 contacts the drum 1 to provide a gap between the charging portion 222 and the drum 1, across which the electric discharge occurs. At least a part of the non-charging portion 221 is made of a high resistance material having a resistance higher than that of the charging portion 222 to prevent discharge between the non-charging portion 221 and the surface of the drum 1. Designated by 220 is a discharging position where the drum is charged through the fine gap g (FIG. 4). The fine gap g will be described hereinafter.

Designated by 223 is an elastic member of metal (metal leaf spring), and), 224 is a holder. The elastic member 223 supports the charging portion 222 and the non-charging portion 221. In this embodiment, the holder 224 is made of electroconductive material, and the holder 224 and the charging portion 222 are electrically conduced by the elastic member 223, so that the charging voltage is applied from the voltage source E to the charging portion 222 through the holder 224 and the elastic member 223.

Figure 16:
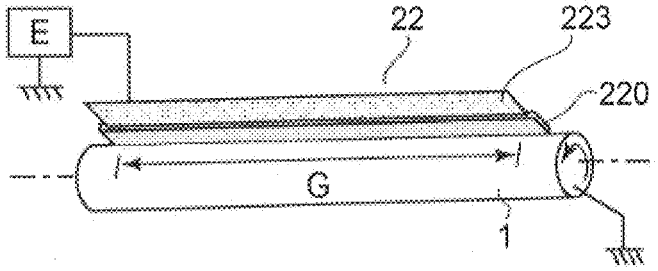
FIG.16 PRIOR ART
In FIG. 16, part (a) is a schematic perspective view the charging blade, and (b) illustrates a problem.
Figure 16:
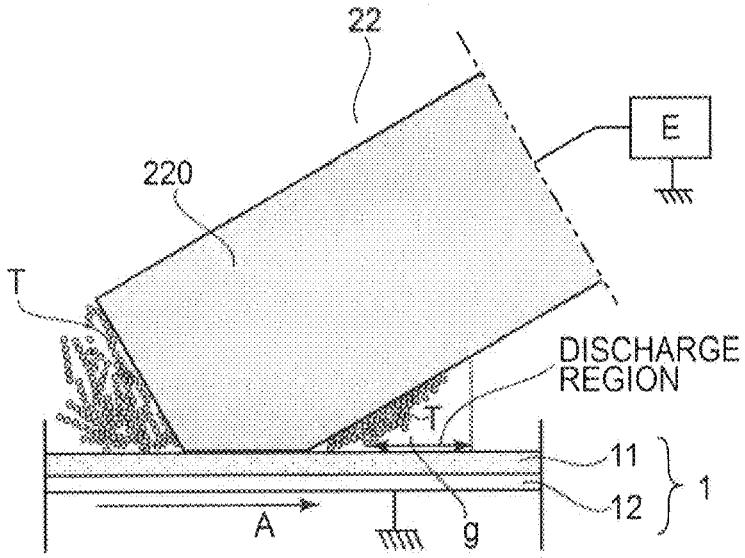
FIG.16 PRIOR ART
Figure 17:
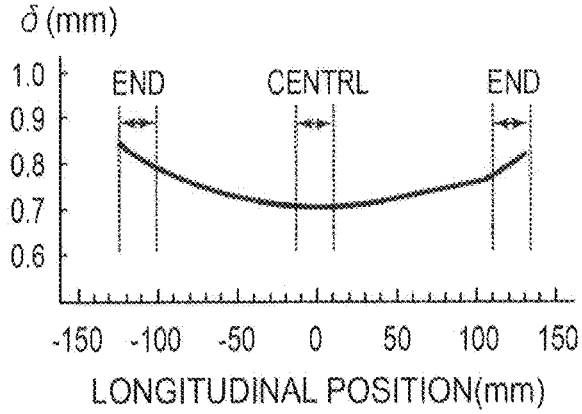
FIG.17 PRIOR ART
FIGS. 17(*a*)-17(*c*) also illustrate a problem.
Figure 17:
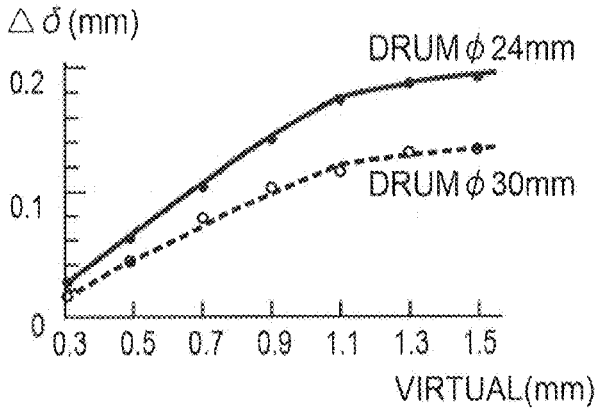
FIG.17 PRIOR ART
Figure 17:
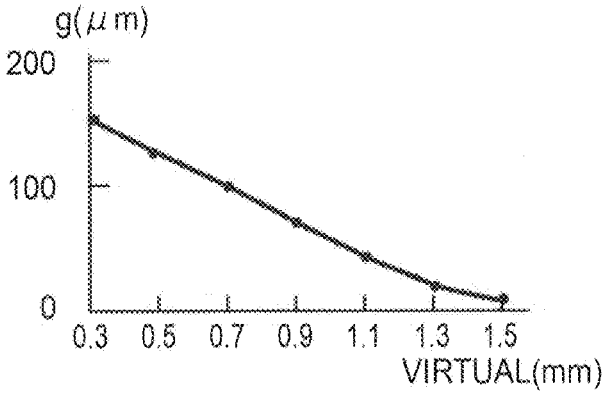
FIG.17 PRIOR ART

The charging portion 222 is elongate in a generatrix direction of the drum 1 (drum axis direction), and is long enough to cover the entirety of an image forming region G of the drum 1 (charging region width in part (a) of FIG. 16). The charging portion 222 comprises rubber and electroconductive powder added thereto to provide a resistance value of 1×10^3-1×10^9 Ωcm. The rubber is SBR, BR, EPDM, urethane, silicone rubber, chloroprene, epichlorohydrin rubber or the like. The electroconductive powder is carbon black, metal oxide (zinc oxide, titanium oxide or the like).

If the resistance of the charging portion 222 is smaller than 1×10^3 Ωcm, the current leakage may occur when the drum 1 has a defect such as a pin hole, with the result of image defect white strips or black stripes. If, on the contrary, it is not less than 1×10^9 Ωcm, the attenuation of applied voltage is so large that the chargeable is poor. Therefore, the resistance value of the charging portion 222 is desirably 1×10^3 Ωcm -1×10^9 Ωcm.

Part (a) and part (b) of FIG. 4 are schematic views of the charging blade 22 contacted to the photosensitive drum 1 at the free end of the blade. Charging blade 22 is disposed parallel to the generatrix direction of the drum 1. An edge portion of the non-charging portion 221 is contacted to the drum 1, the holder 224 is fixed to the casing of the cartridge 50, and the edge portion is contacted to the drum 1 at a predetermined urging force by an elastic reaction force of the metal elastic member 223.

In this contact state, the charging portion 222 is out of contact to the drum 1. And, the discharging position 220 of the charging portion 222 is out of contact with a dischargeable gap g (g1, g2) from the drum 1.

In the charging blade 22 of this embodiment, the discharging position 220 of the charging portion 222 is a meeting portion between a connection end surface of the charging portion 222 relative to the non-charging portion 221 and a surface of the charging portion 222 opposing the drum 1. That is, the discharging position 220 is the closest position between the charging portion 222 and the drum 1.

The predetermined charging bias voltage is applied to the electroconductive holder 224 from charging bias voltage applying source E, and the bias voltage is applied to the charging portion 222 through the holder 224 and the metal elastic member 223. By this, the discharge occurs to the surface of drum 1 across the small gap g between the discharging position 220 of the charging portion 222 and the drum 1 to charge uniformly the surface of the rotating drum 1 to the predetermined polarity and potential.

In order to effect the charging stably, the small gap g is not less than 7.5 μm and not more than 150 μm, desirably not less than 7.5 μm and not more than 100 μm. If the small gap g is less than 7.5 μm, the discharge does not occur as will be understood from the Paschen law. If, on the other hand, the small gap g is not less than 150 μm, the discharge occur, but is non-uniform with the result of defective image having spots. Therefore, for the stabilized discharge, the gap g is desirably not more than 100 μm.

The lower limit value of the small gap g for generating the discharge is constant irrespective of the applied voltage or the discharging member. The lower limit value of the small gap g for the generation of the discharge changes to a certain extent by the ambient pressure. In this embodiment, the above-mentioned 7.5 μm is based on (760 torr). This ambient pressure is an ordinary condition.

In this embodiment, the distance between the drum 1 and the charging portion 222 is not less than 7.5 μm and not more than 150 μm, and the position on the charging portion 222 at the closest position between the drum 1 and the charging portion 222 is the discharging position 220.

verification has been made as to whether or not the theoretical discharging position 220 and the actual discharging position are the same. In the state that the charging blade 22 is press-contacted to the drum 1 which is not rotating, a predetermined charging potential is applied for a predetermined duration. A position of a trace of discharging on the charging portion 222 (discharging trace) is deemed as the actual discharging position. The applied charging potential is enough if the discharge continues, and by applying a sine wave AC voltage having a peak-to-peak voltage 2.0 kV, for example, for 10 minutes, a discharging trace is produced on the charging portion 222.

The result exhibited the position of the discharging trace and the theoretical discharging position are substantially the same. From the foregoing, the above-described theoretical determination of the discharging position is correct.

The non-charging portion 221 will be described. The non-charging portion 221 is directly contacted to the drum 1 at the free end portion of the charging blade 22. In this embodiment, the non-charging portion 221 of the charging blade 22 is made of a urethane rubber having a volume resistivity not less than 1×10^11 Ωcm and a micro rubber hardness of 72° (JIS-A). Other insulative rubber material such as a silicone rubber is usable.

The charging blade (charging member) 22 of the present invention is such that an amount of deformation of the charging blade when a force is applied to the non-charging portion 221 is larger in the central portion in the longitudinal direction of the charging blade (charging member) than in the end portions thereof.

In this embodiment, in order to provide the charging blade with such a property, the charging member is provided with a groove or a cut-away portion extending in the longitudinal direction of the charging member. A depth of the groove or a depth of the cut away portion is larger in the central portion than in the end portions with respect to longitudinal direction of the charging member.

As shown in part (b) of FIG. 1, in the charging blade 22 of this embodiment, the charging blade is provided with a groove portion U1 having a width Ua and extending along the longitudinal direction thereof between the discharging position 220 and the free end portion of the charging blade 22 contacting the drum 1. The groove portion U1 is provided in a side of the charging blade opposing the drum 1. The depth X of the groove portion U1 measured in the direction of the thickness of the blade is larger in the central portion than in the end portions with respect to the longitudinal direction of the charging blade. By doing so, when the charging blade 22 is contacted to the drum 1, the free end portion of the charging blade 22 deforms.

In this case, as shown in (a) of FIG. 4, the groove depth X1 in the central portion (central region) of the charging blade is larger than those X2 in the longitudinal end portions (end regions). Therefore, the deformation amount is larger in the central region than in the longitudinal end portion regions.

Figure 5:
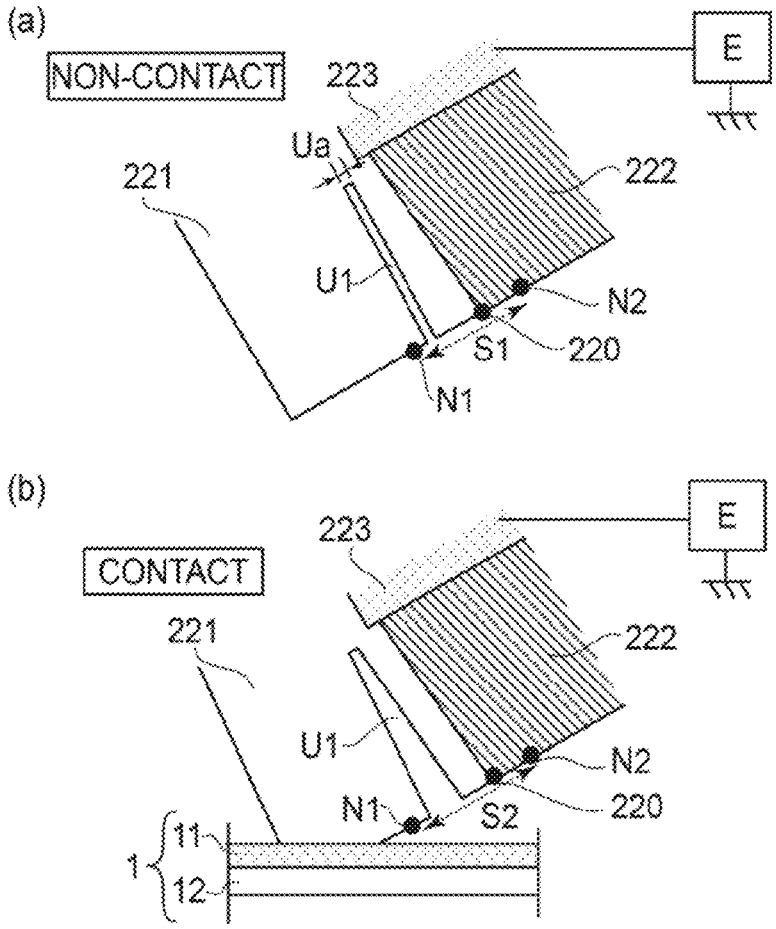
FIGS. 5(*a*) and 5(*b*) are schematic views illustrating an amount deformation of the charging blade.

The deformation amount of the charging blade will be described. A distance S1 between a point N1 and a point N2 in the non-contact state relative to the drum as shown in part (a) of FIG. 5 and a distance S2 between the point N1 and the point N2 in the contact state in which the charging blade 22 is contacted to the metal drum of the 30 mmϕ with a predetermined set angle and virtual bite δ as shown in (b) of FIG. 5, are measured. The difference (S2-S1) is a deformation amount Z of the charging blade. The point N1 of the charging blade is any point between the free end of the blade and the groove portion U1, and a point N2 is any point on the charging portion 222.

A deformation amount Z1 in the central portion of the image region of the charging blade when the charging blade is contacted to the metal drum of the 30 mmϕ with the predetermined set angle and virtual bite δ and a deformation amount Z2 in an end portion (20 mm inside from the end of the maximum image forming region) in the same condition, are measured. That is, a difference ΔZ=(deformation amount Z1−deformation amount Z2) when the same force is applied to the non-charging portion 221 of the charging blade satisfy ΔZ>0.

This will be described in more detail. The measurement of the deformation amount Z is made using a cut out test piece (longitudinally central portion piece and longitudinally end portion piece). The test pieces are observed facing the sectional surface using a laser microscope to measure the deformation amount Z and the difference ΔZ.

(3) Verification Experiment

Image formation tests were carried out using an image forming apparatus 100 to which the cartridge 50 provided with the charging blade 22 is mounted. For these tests, 6 cartridges 50 having different virtual blade bites δ were prepared, and 8000 sheets image formation tests were carried out under the normal temperature and normal humidity ambient condition (N/N ambient condition), that is, 23° C./50%. For the comparison, the same tests were carried out using a charging blade not employing the present invention. The specific data of the charging blade are as follows:

<Charging Blade 22 of this Embodiment> a) free length L1: 7.0 mm:

b) thickness T: of blade 2.0 mm:

c) length L2: 5.0 mm:

d) supporting member 223:

Phosphor bronze, thickness=0.1 mm

Distance L3 from the free end to the phosphor bronze: 0.8 mm:

e) charging portion 222:

Material: carbon-dispersed polyurethane

Volume resistivity: 1×10^5 Ωcm

Distance L4 from the free end to the electroconductive portion: 1.0 mm:

f) groove portion U1

Distance Y from the free end to the groove portion: 0.7 mm

Width Ua of the groove portion U1: 0.1 mm

Depth X: 0-1.0 mm (arcuate as seen from longitudinal end in (a) of the FIG.)

0.0 mm at the end portion:

1.0 mm at the central portion:

<Charging Blade 22 of Comparison Example 1>

Conventional charging blade not provided with the groove portion U1 between the charging portion and the free end portion, and an insulative urethane rubber is formed at the free end contacting the drum 1.

<Conditions of the Image Forming Operation> a) Charging Blade Set Condition

Virtual bite δ (mm)=0.3, 0.5, 0.7, 0.9, 1.1, 1.3

Setting angle θ=25°

Conditions of image forming operation

Process speed: 100 mm/sec

Drum diameter: ϕ24

Cleaning blade 7*a*: urethane rubber, counterdirectional contact

Applied bias: DC-950-1500V variable (in order to provide the desired dark portion VD, the applied bias is changed in accordance with the virtual bite δ)

Potential setting: dark portion VD=−500V, light portion VL=−100V.

The results are shown in Table 1. In the image forming tests using the 22 of this embodiment, the proper charging property has been kept up to 8000 sheets even when the virtual blade bite δ is different. In the case of the charging blade 22 of comparison example 1 not using this embodiment, non-uniform density image between the central portion and the end portions.

TABLE 1

| | Density Uniformity | | | | | |
|---|---|---|---|---|---|---|
| | Virtual bite δ (mm) | | | | | |
| | 0.3 | 0.5 | 0.7 | 0.9 | 1.1 | 1.3 |
| Embodiment | G | G | G | G | G | F |
| Comparison Example | G | F | NG | NG | NG | NG |

G: Good
F: Fair
NG: No good

Figure 6:
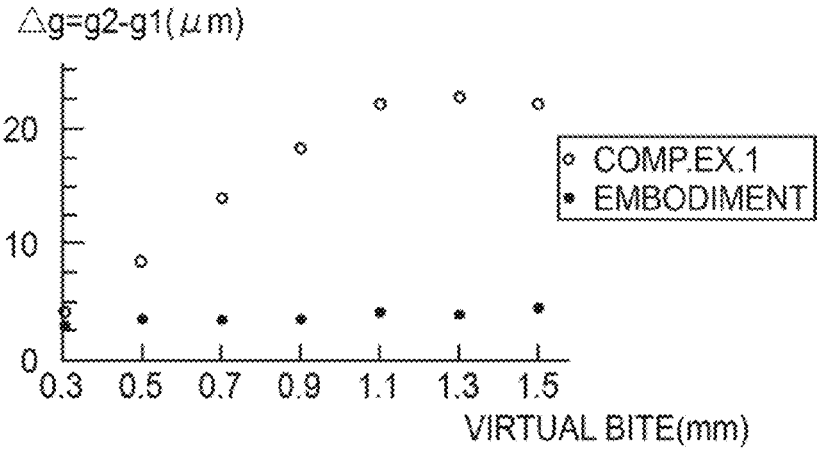
FIG. 6 illustrates effects of the charging blade in Embodiment 1.

The causes of the facts are considered as follows. FIG. 6 shows a virtual blade bite dependence of center-end difference of the small gap g. As shown in FIG. 6, with the charging blade 22 of the conventional structure (comparison example 1), when the virtual blade bite δ is small the deformation of the drum 1 is small, and therefore, no gap difference Δg between the end portion and the central portion arise, so that satisfactory images are produced.

When the virtual blade bite δ is about 0.5 mm, the small gap difference Δg arises, but the non-uniform density in the images is practically not problematic. When δ is larger than 0.7 mm, the flexure or deformation of the drum and therefore the gap difference are so large that the charged potential is uneven along the longitudinal direction. As a result, the formed images are non-uniform in the density.

On the other hand, in the charging blade 22 of this embodiment, the density uniformity of the image in the longitudinal direction is satisfactory. As shown in FIG. 6, the gap difference Δg is independent from the virtual bite but is substantially uniform. This is because the virtual bite δ of the charging blade 22 in the central region is reduced by the deformation or flexure of the drum 1, but the groove portion is effective to make larger the deformation of the charging blade 22 in the central portion than in the end portions, and therefore, the charging blade 22 can follow the flexure of the drum 1. Therefore, the gap difference Δg is substantially eliminated, thus making the charged potential uniform and stable. As a result, the uniform density of the images can be accomplished.

As described in the foregoing, according to this embodiment, even when the drum flexes, satisfactory output images can be provided stably in a broad range of the virtual bite δ of the charging blade. In this embodiment, the groove portion U1 is provided in a side opposing the drum 1, but the uniform image density can be provided also when the groove portion U1 is provided in the side not opposing the drum 1 as shown in part (a) of FIG. 7.

Figure 7:
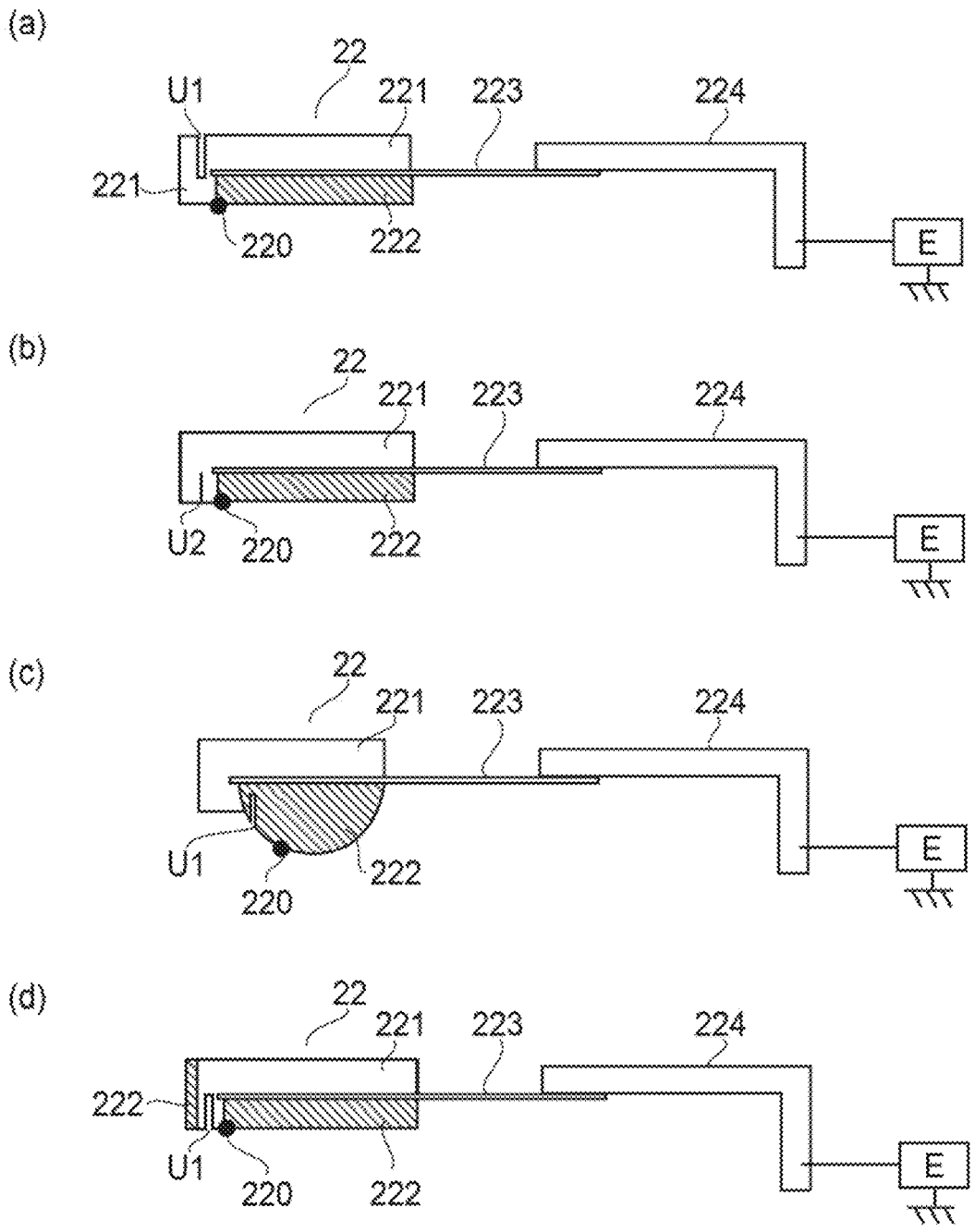
FIGS. 7(*a*)-7(*d*) are schematic views of the charging blades of other examples in Embodiment 1.

In this embodiment, the charging blade is provided with the groove portion U1, but in an alternative example, a cut away portion U2 is formed between the free end of the blade and the discharging position 220 as shown in part (b) of FIG. 7, and the same effects are provided.

The position of the groove portion U1 or the cut away portion is not limited to the non-charging portion 221. In the case of the charging blade 22 having a convex or protruding discharging position 220 as shown in part (c) of FIG. 7, the groove portion U1 or cut away portion U2 may be in the charging portion 222 if it is between the free end of the blade and the discharging position 220.

The non-charging portion 221 will suffice if no discharge resulting in charging of the surface of the drum 1, and as shown in part (d) of FIG. 7, a multi-layer structure is possible if the non-charging portion 221 is provided between the free end portion of the blade and the discharging position 220, in which the free end portion is the charging portion (electroconductive material portion) 222.

[Embodiment 2]

Figure 8:
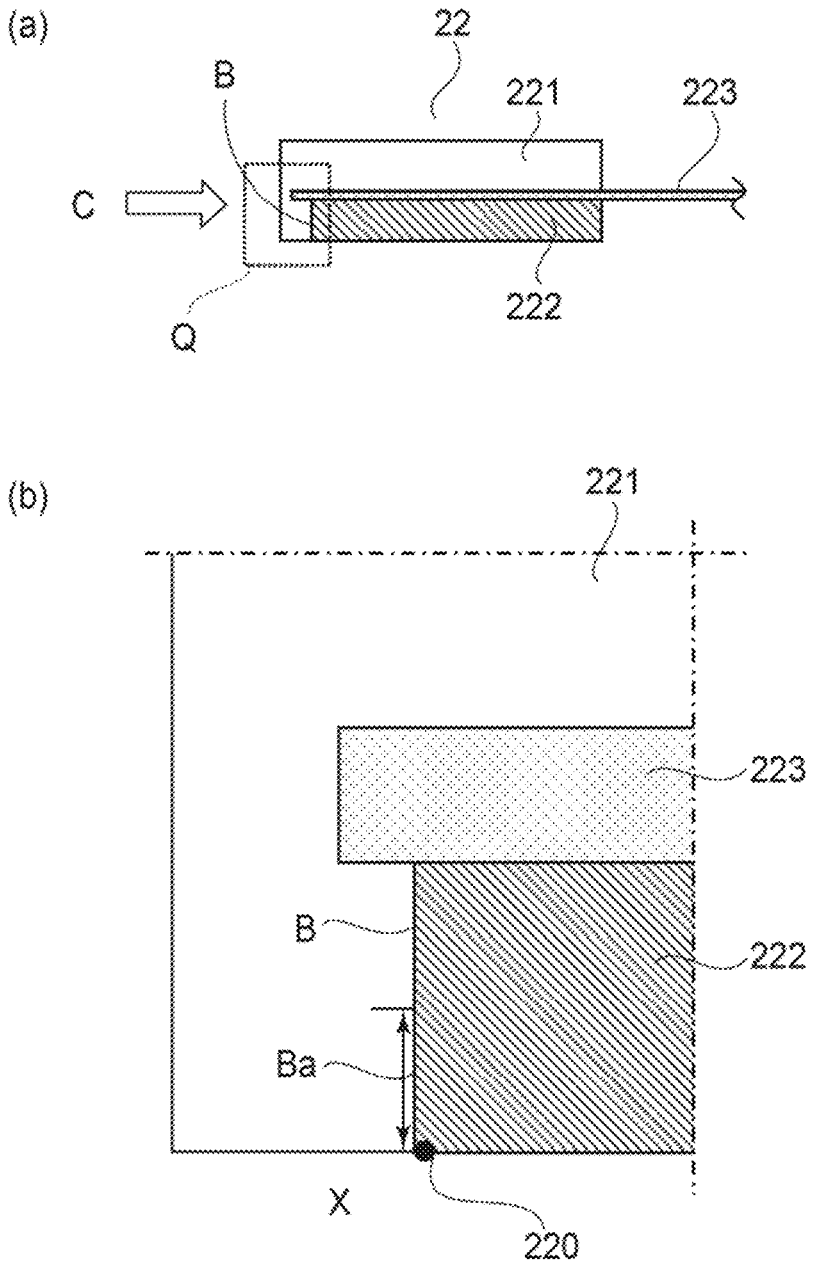
FIGS. 8(*a*) and 8(*b*) are illustrations of a charging blade according to Embodiment 2 of the present invention.

Part (a) of FIG. 8 is an illustration of a charging blade 22 of Embodiment 2, and (b) is an enlarged view of the free end portion (broken line portion Q in (a)) of a blade 22. The feature of this embodiment is that in a bonded portion B between a charging portion (first charging member portion) 222 of the charging blade 22 and a non-charging portion (second charging member portion) 221, bonding widths measured in the thickness direction are different between the longitudinal end portion and central portion of the blade.

More particularly, in the charging member 22 of this embodiment, a first charging member portion 222 and a second charging member portion 221 are bonded with each other by an adhesive material along the longitudinal direction of the charging member while a non-bonded portion Ba is provided. That is, the first charging member portion 222 and the second charging member portion 221 are bonded to each other by the bonded portion B. And, a non-bonding width Ba which is a width of the non-bonded portion Ba measured in the thickness direction of the charging member is larger in the longitudinally central portion than in the longitudinally end portion.

In this embodiment, the non-charging portion 221 and the charging portion 222 are bonded to each other by applying a primer (adhesive material) such that a distance from the surface of the side opposing the drum 1 to the bonded portion B is larger in the central portion than in the end portion. The details of the bonded portion B are as follows. The structures other than the bonded portion B are the same as with Embodiment 1.

Distance X: 0.2 mm at end portions X2 (position 20 mm away from the end of the image forming region).

Central portion X1: 1.0 mm.

Figure 9:
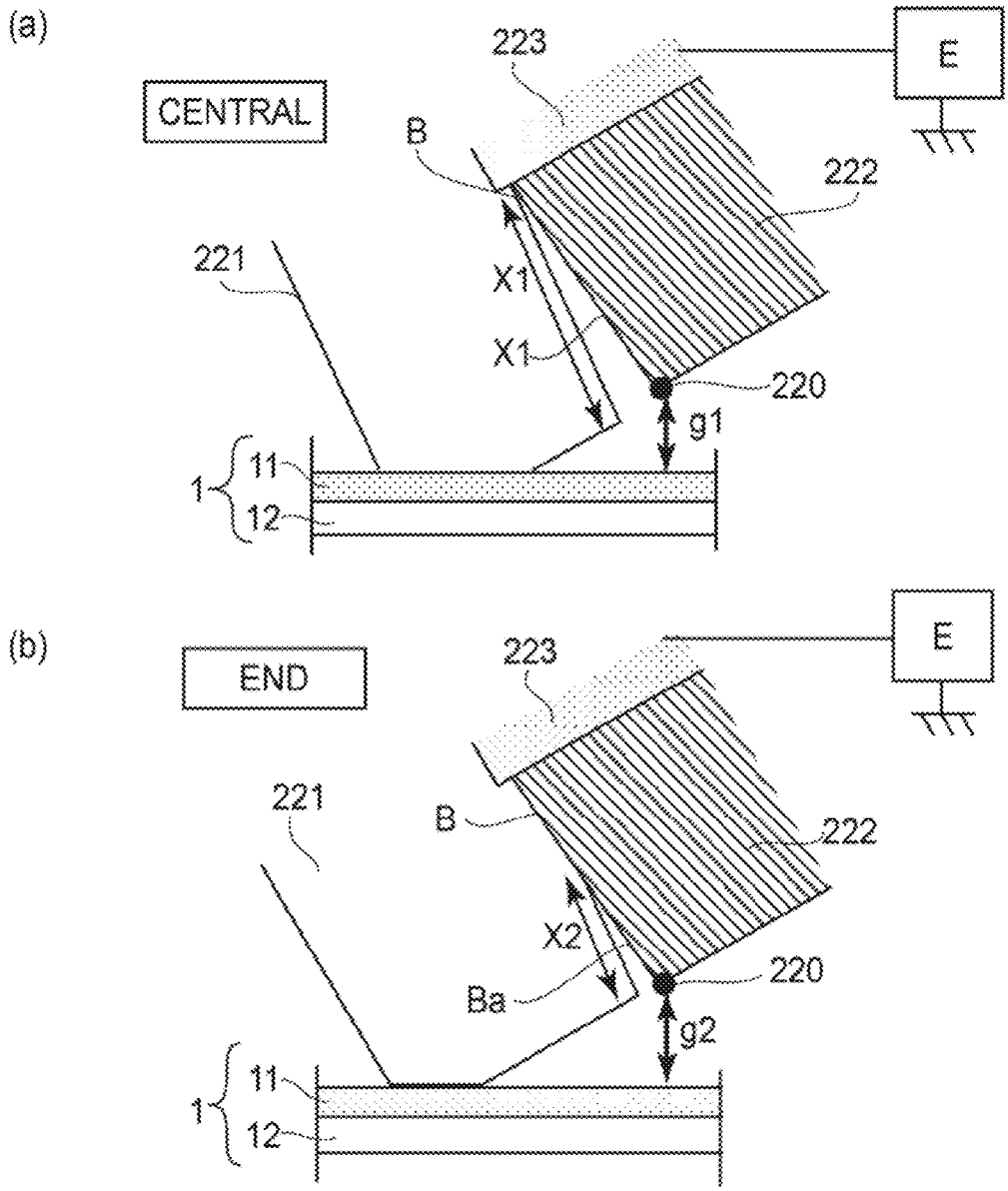
FIGS. 9(*a*) and 9(*b*) illustrate a function of the charging blade in Embodiment 2.

With this structure, as shown in parts (a) and (b) of FIG. 9, a deformation amount of the charging blade is larger in the central portion (central region) than in the end portions (end region), and therefore, similarly to Embodiment 1, the small gap between the discharging position 220 and the drum 1 can be uniform along the longitudinal direction even when the drum 1 flexes.

(Verification Experiment)

Image formation tests were carried out using an image forming apparatus 100 to which the cartridge 50 provided with the charging blade 22 is mounted, similarly to Embodiment 1. The results are shown in Table 2.

TABLE 2

| Density Uniformity | | | | | | |
|---|---|---|---|---|---|---|
| | Virtual bite δ (mm) | | | | | |
| | 0.3 | 0.5 | 0.7 | 0.9 | 1.1 | 1.3 |
| Embodiment | G | G | G | G | G | F |

G: Good
F: Fair
NG: No good

Figure 10:
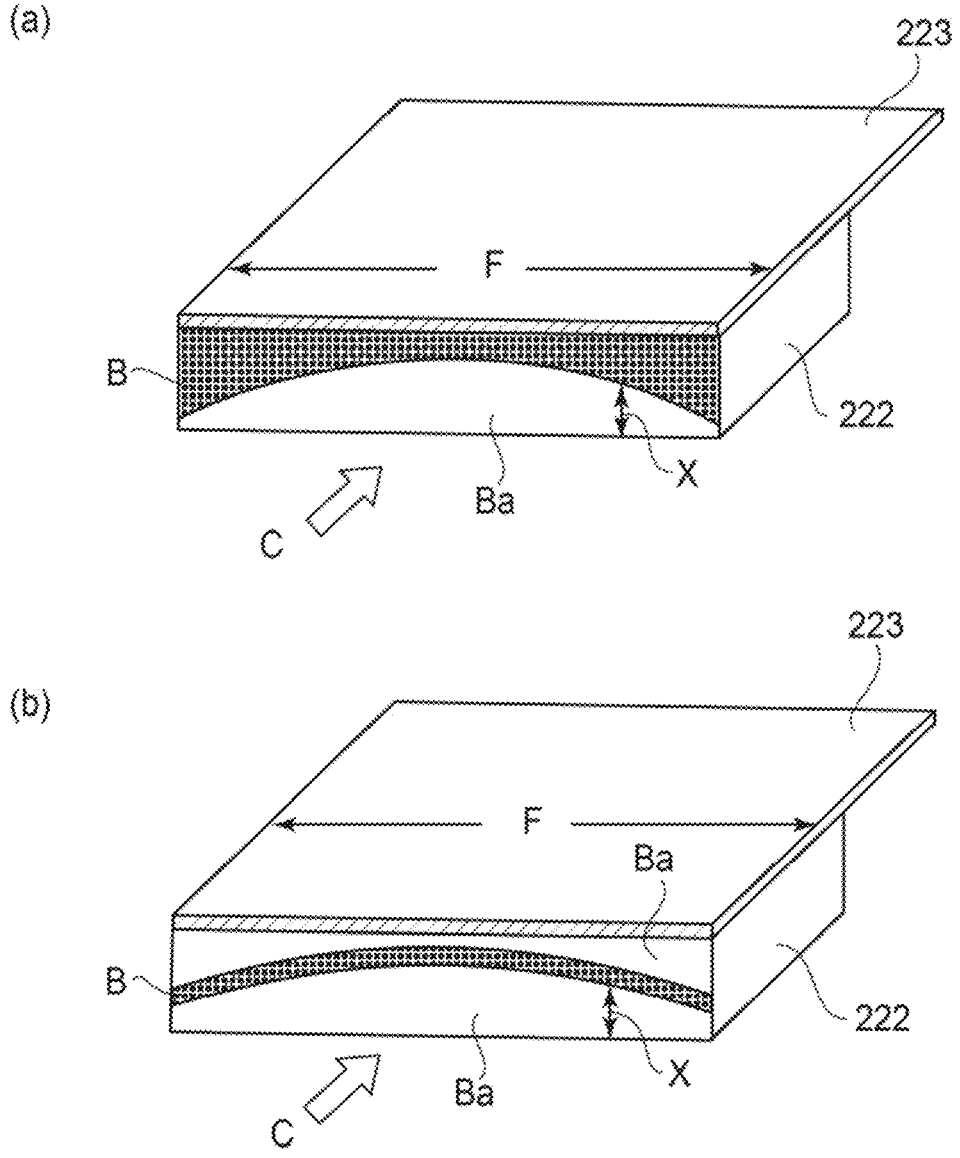
FIGS. 10(*a*) and 10(*b*) illustrate a bonding portion and a non-bonded portion.

Part (a) of FIG. 10 shows a distribution of the bonding width of the bonded portion B between the charging portion 222 and the non-charging portion 221, along the longitudinal direction F of the blade 22. It is a perspective view as seen in the direction C in part (a) of FIG. 8, and in part (a) of FIG. 10, the non-charging portion 221 is not shown. In this embodiment, the width of the bonded portion B is as shown in part (a) of FIG. 10, and in an alternative example shown in part (b) of FIG. 10, a narrow bonded portion B is away by a distance X which is longer in the central portion than in the end portions as will be understood.

As described in the foregoing, according to this embodiment, even when the drum 1 flexes, the satisfactory output images can be produced stably in a wide range of the virtual bite δ of the charging blade 22.

[Embodiment 3]

Figure 11:
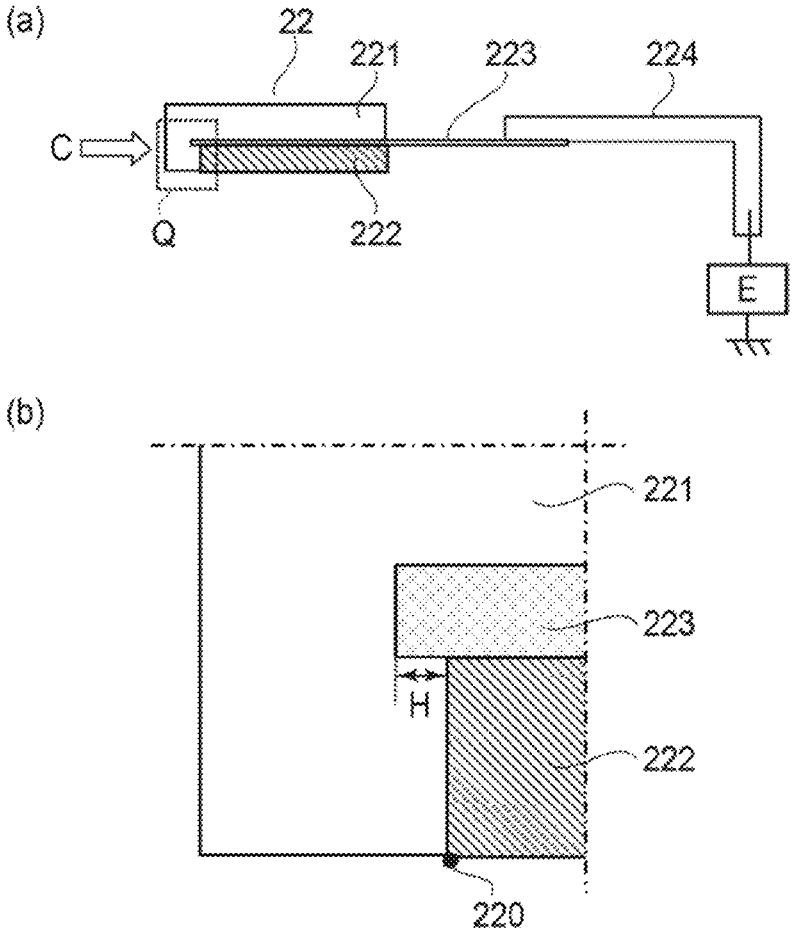
FIGS. 11(*a*) and 11(*b*) are illustrations of a structure of the charging blade according to Embodiment 3.

Part (a) of FIG. 11 is an illustration of the charging blade 22 of Embodiment 3, and (b) is an enlarged view of the free end portion (broken line portion Q in (a)) of a blade 22. The feature of this embodiment is in that a protruding amount H of an elastic metal member (metal plate spring member) 223 is different between the longitudinal end portion and central portion of the blade. More particularly, there are provided a charging portion 222 and an elastic metal member 223 supporting a non-charging portion 221, and a free end of the elastic metal member 223 protrudes beyond the free end position of the charging portion 222, and the protruding amount H is larger in the end portion than in the central portion in the longitudinal direction of the charging member.

Figure 12:
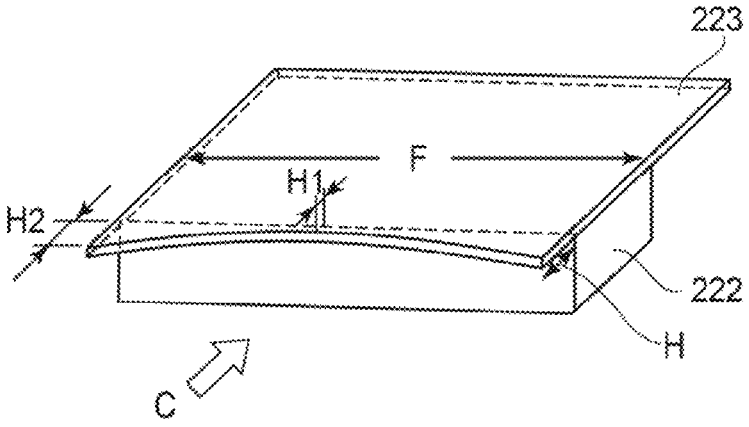
FIG. 12 is another illustration of a structure of the charging blade according to Embodiment 3.

FIG. 12 is a perspective view as seen in the direction C in part (a) of FIG. 11, and in part (a) of FIG. 12, the non-charging portion (insulating portion) 221 is not shown. As shown in FIG. 12, in this embodiment, the protruding amount H of the elastic metal member 223 is smaller in the central portion than in the end portions. The details of the charging blade 22 in this embodiment are as follows.

a) Elastic Metal Member 223

Elastic metal member 223: phosphor bronze having a thickness of 0.1 mm.

End configuration: arcuate (the longitudinally central portion is recessed by 0.4 mm as compared with the end portions).

Protruding amount (distance between a free end of the elastic metal member 223 and the charging portion 220) H:

Central portion H1: 0.1 mm.

End portion H2: 0.5 mm.

b) Non-charging Portion 221

Material: urethane rubber

Hardness (JIS-A): 72°

Thickness S1: 2 mm

A distance L4 between the free end portion and the discharging position 220: 0.7 mm.

Figure 13:
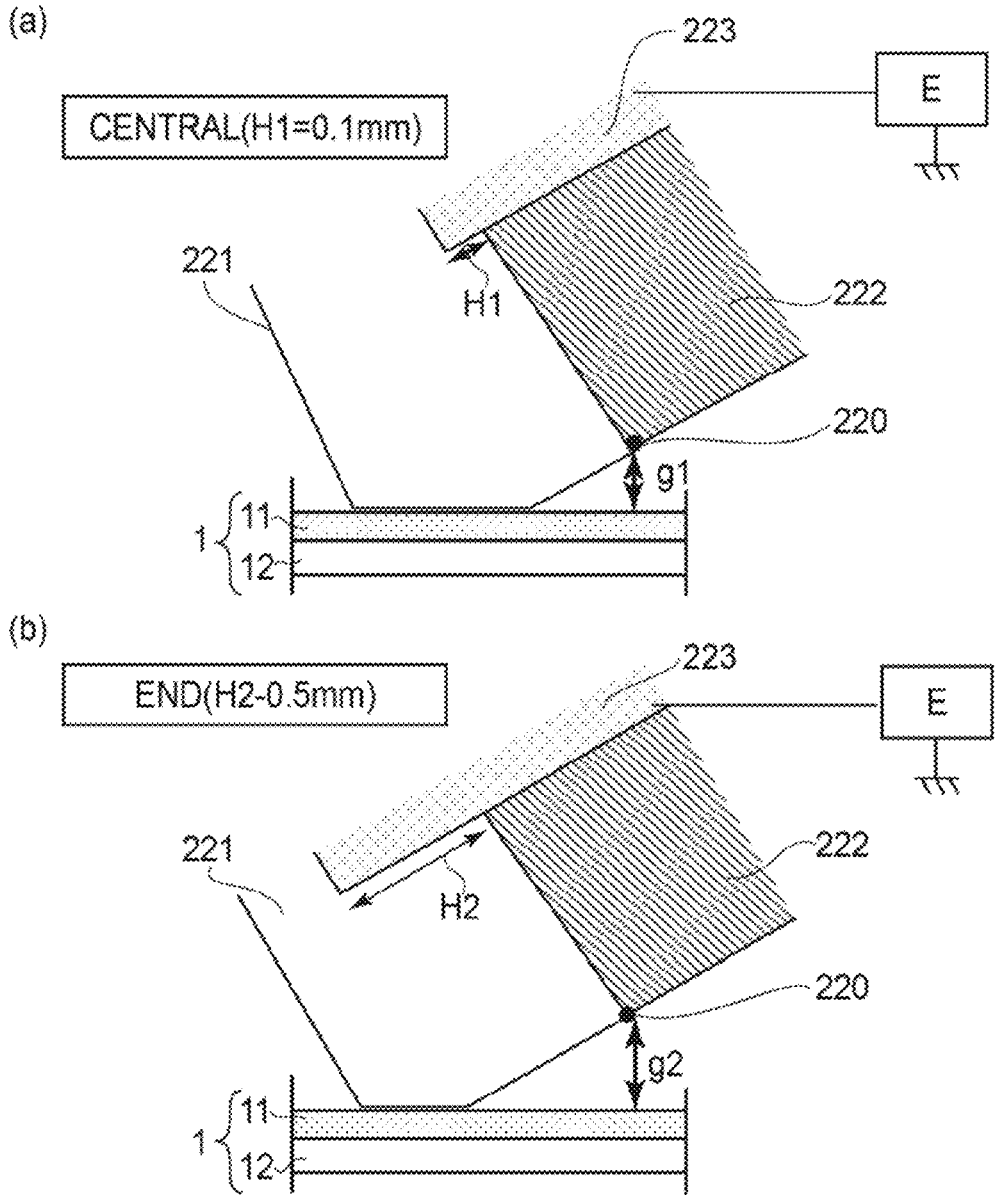
FIGS. 13(*a*) and 13(*b*) illustrate a function of the charging blade in Embodiment 3.

By this, as shown in FIG. 13, the deformation amount Z of the charging blade 22 is larger in the central portion than in the end portion, and similarly to Embodiment 1, even when the drum 1 flexes, the small gap g between the discharging position 220 and the drum 1 can be made uniform along the longitudinal direction.

(Verification Experiment)

Figure 14:
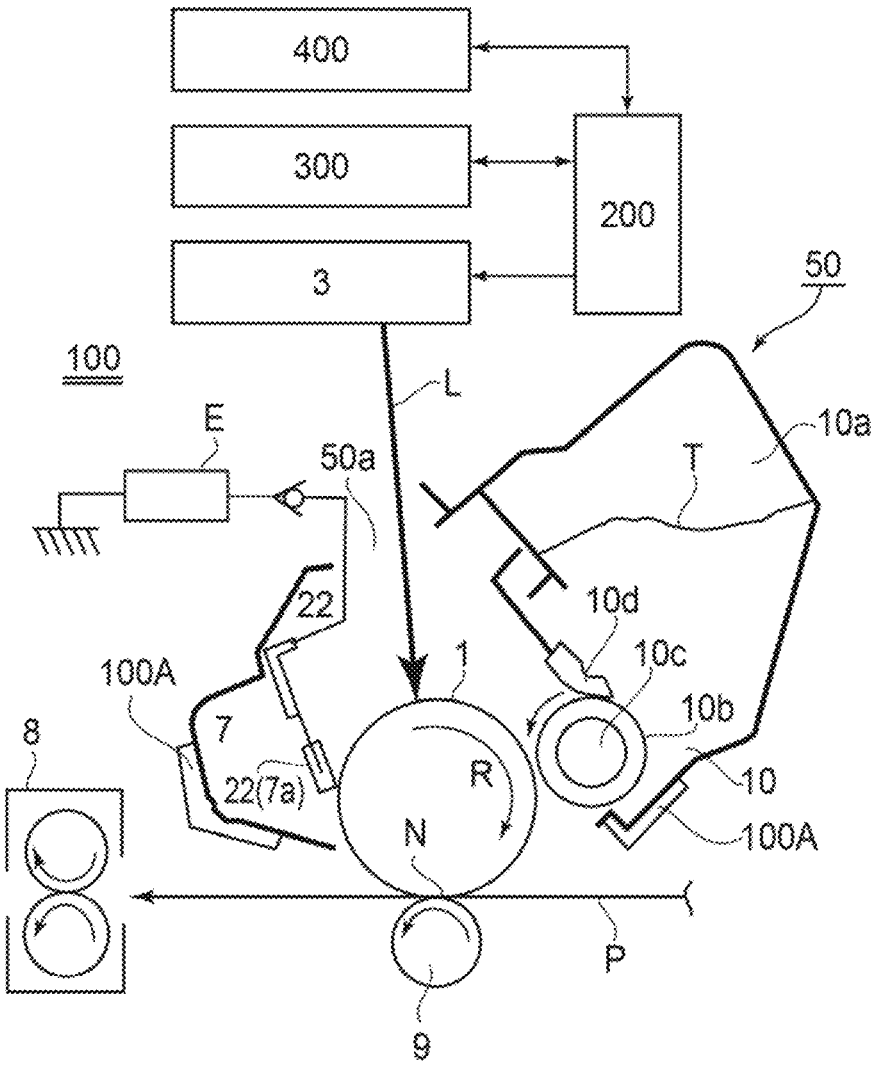
FIG. 14 is a schematic illustration of an image forming apparatus according to an embodiment in which the charging blade of the Embodiment 3 is used both for a cleaning functioning and also for a charging blade.
Figure 15:
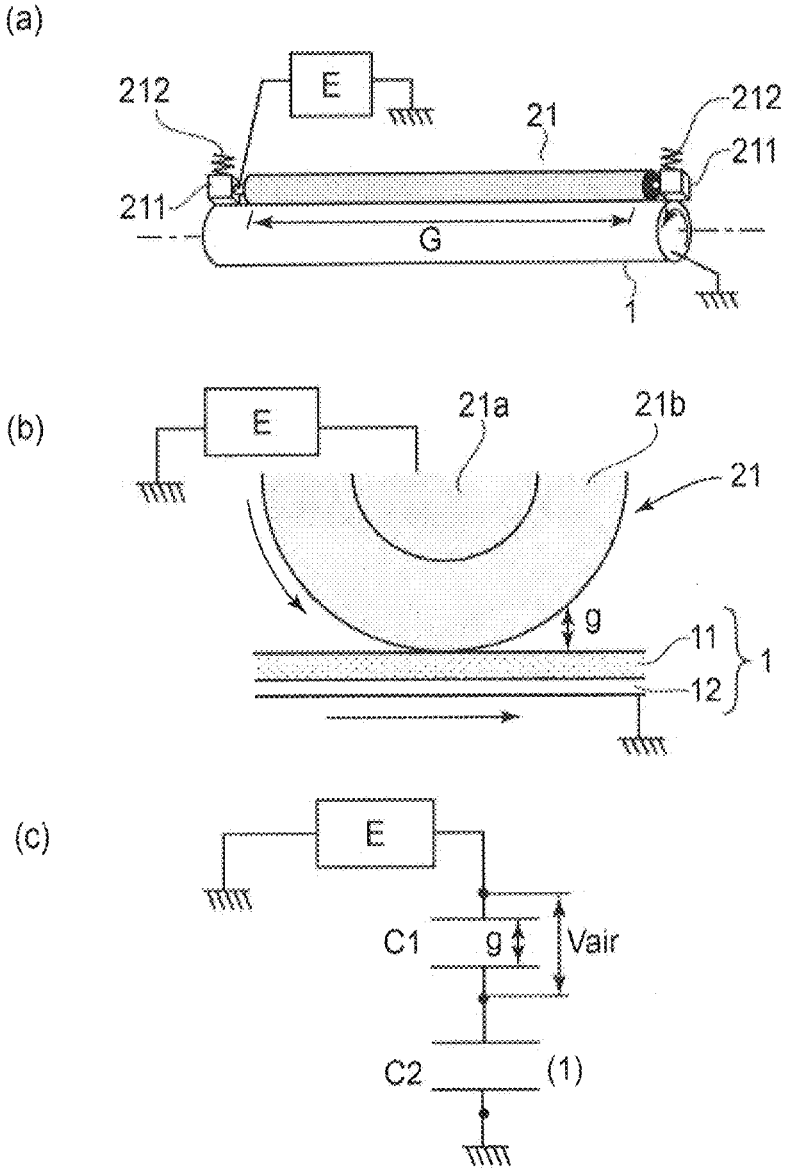
FIG.15 PRIOR ART
In FIG. 15, part (a) when part (b) are schematic perspective views of a charging roller, and part (c) is an electrical equivalent circuit diagram of a charging roller, a drum and an air layer of a fine gap therebetween.

Image formation tests were carried out using an image forming apparatus 100 to which the cartridge 50 provided with the charging blade 22 is mounted, similarly to Embodiment 1. In this embodiment, the non-charging portion (insulative portion) 221 of the charging blade 22 functions to clean the surface of the drum, and therefore, the charging blade 22 of this embodiment is a cleaning and charging blade as shown in FIG. 14. By doing so, the cartridge 50 and the image forming apparatus can be downsized and reduced in cost. Durability test of 8000 sheets was carried out under the N/N ambient condition. The conditions of the image formation are as follows: The results are shown in Table 3.

<Image Forming Conditions>

Process speed: 100 mm/sec

Drum diameter: ϕ24

TABLE 3

Density Uniformity and Cleaning Property

| | Virtual bite δ (mm) | | | | | | |
|---|---|---|---|---|---|---|---|
| | 0.3 | 0.5 | 0.7 | 0.9 | 1.1 | 1.3 | 1.5 |
| Image uniformity | G | G | G | G | G | F | F |
| Cleaning property | NG | F | G | G | G | G | F |

G: Good

F: Fair

NG: No good in the density uniformity or cleaning property.

As will be understood, with the virtual bite δ=0.3 mm, the image uniformity is satisfactory, but the cleaning property us insufficient. This will be because the contact pressure between the cleaning and charging blade 22 and the drum is insufficient. When the virtual bite δ is not less than 1.5 mm, the cleaning property is practically acceptable, but the flexure of the drum 1 is so large that the image uniformity is not satisfactory. In the case of the virtual bite δ=0.5 mm-1.5 mm, both of the image density uniformity and the cleaning property are satisfactory, and the satisfactory images can be provided.

As described in the foregoing, according to this embodiment of the present invention, the charging blade can charge the drum stably in a wider range of the virtual bite δ of the charging blade, and the cleaning property is satisfactory, and therefore, a downsized image forming apparatus capable of forming satisfactory images with a smaller number of parts. In addition, the charging blade contacts to and slides on the drum 1 stably all over the image region of the surface of the drum, and therefore, the output images are uniform along the longitudinal direction.

[Others]

1) the image bearing member on which the electrostatic latent image is formed is not limited to the electrophotographic photosensitive member for an electrophotographic type apparatus of the embodiments. It may be a dielectric member for electrostatic recording for an electrostatic recording type apparatus. The image bearing member is not limited to the drum type. It may be an endless rotatable belt, a traveling non-endless belt or the like. The image bearing member may be a sheet-like member (electro-facsimile machine paper, electrostatic recording paper) fed by a feeding means.

2) the relative movement between the image bearing member and the charging member is not limited to the case in which the image bearing member moves relative to the fixed charging member as in the foregoing embodiments, but the charging member may move relative to the fixed image bearing member, or both of the charging member and the image bearing member move with relative movement therebetween.

3) the contact of the charging member relative to the image bearing member is not limited to the counterdirectional contact as in the foregoing embodiments, but the codirectional contact may be employed. In addition, the edge contact is not inevitable, but convex contact can be employed.

4) in the present invention, the charging of the surface of the image bearing member by the charging member is not limited to applying the electric charge thereto, but includes the case of electrically discharging the image bearing member, that is, removing the electric charge from the image bearing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 278184/2010 filed Dec. 14, 2010 which is hereby incorporated by reference.

What is claimed is:

1. A blade-like charging member for charging a surface of an image bearing member by contacting thereto and by being supplied with a voltage, said blade-like charging member comprising:

a charging portion for effecting electric discharge to the surface of the image bearing member;

a non-charging portion not effecting the electric discharge to the surface of the image bearing member;

wherein said non-charging portion is capable of contacting the image bearing member while maintaining an electrically dischargeable gap between said charging portion and the image bearing member, wherein at least a part of said non-charging portion is made of a material having a higher resistance than a resistance of said charging portion so as to prevent electric discharge between said non-charging portion and the surface of the image bearing member, wherein said charging portion charges the image bearing member by producing electrical discharge in the gap between said charging portion and the image bearing member, wherein said non-charging portion deforms when it contacts said image bearing member to narrow the gap between said charging portion and the image bearing member, wherein an amount of deformation of said non-charging portion when a force is applied to said non-charging portion in a longitudinally central portion is larger than an amount of deformation of said non-charging portion when the same force is applied to said non-charging portion in a longitudinally end portion, and wherein said blade-like charging member is provided with a groove extending in a longitudinal direction of said blade-like charging member, and a depth of said groove in the longitudinally central portion is larger than a depth of said groove in the longitudinally end portion.

2. The blade-like charging member according to claim 1, wherein said groove is provided in a side of said blade-like charging member opposing the image bearing member.

3. The blade-like charging member according to claim 1, wherein said groove is provided in a side opposite a side of said blade-like charging member opposing the image bearing member.

4. The blade-like charging member according to claim 1, said charging portion and said non-charging portion are bonded to each other by a bonding portion of an adhesive material so as to provide a non-bonded portion therebetween, said non-bonded portion extending along the longitudinal direction of said blade-like charging member, and said non-bonded portion extending from a side of said blade-like charging member opposing the image bearing member in a thickness direction of said blade-like charging member, wherein said groove is formed between said non-charging portion and said charging portion in said non-bonding portion, wherein a width of the non-bonded portion measured in the thickness direction is larger in the longitudinally central portion than in the longitudinally end portion, and wherein said non-charging portion deforms so as to expand a space between said non-charging portion and said charging portion in the non-bonded portion.

5. The blade-like charging member according to claim 1, further comprising a plate spring member of the metal supporting said charging portion and said non-charging portion, with a free end of said plate spring member protruding beyond a position of a free end of said charging portion, and an amount of the protruding is larger in the longitudinally end portion than in the longitudinally central portion.

6. The blade-like charging member according to claim 1, wherein said non-charging portion contacts a surface of the image bearing member over an entire width of an image forming region and slides on the surface of the image bearing member.

7. An image forming apparatus comprising said blade-like charging member according to claim 1, and a voltage source for applying a voltage to said blade-like charging member.

8. The blade-like charging member according to claim 1, wherein said non-charging portion deforms so as to expand a space between said non-charging portion and said charging portion in the groove.

* * * * *